US006769334B1

(12) United States Patent
Whitehead et al.

(10) Patent No.: US 6,769,334 B1
(45) **Date of Patent: *Aug. 3, 2004**

(54) DRIVING WRENCH

(75) Inventors: Michael L. Whitehead, Clarinda, IA (US); Richard Paul LaFlamme, North Kingstown, RI (US); Thomas L. Sluzalis, Lakewood, CO (US)

(73) Assignee: Lisle Corporation, Clarinda, IA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 10/402,050

(22) Filed: Mar. 28, 2003

(51) Int. Cl.[7] ..... B25B 21/02
(52) U.S. Cl. ..... 81/463; 81/177.85; 81/465
(58) Field of Search ..... 81/463, 465, 466, 81/177.85, 177.2, 177.1, 124.7, 180.1, 119, 176.1, 177.5, 177.7, 177.75, 124.6, 124.5; D8/26, 28

(56) References Cited

U.S. PATENT DOCUMENTS

| | | | | | |
|---|---|---|---|---|---|
| D209,705 | S | * | 12/1967 | Hobbs | D8/26 |
| D246,567 | S | * | 12/1977 | Bricker | D8/26 |
| D382,180 | S | * | 8/1997 | Chuang | D8/26 |
| D442,041 | S | * | 5/2001 | Chen | D8/28 |
| 6,354,178 | B2 | * | 3/2002 | Pool et al. | 81/463 |

OTHER PUBLICATIONS

Invention Disclosure Agreement; Norman Leigh; Shock Driver; Nov. 12, 1994.
Invention Disclosure Agreement Richard P. LaFlamme; Right Angle Impact Gun; Feb. 16, 2002.
Invention Disclosure Agreement; Tom Sluzalis; Impact Breaker Tool; Feb. 4, 2002.

* cited by examiner

*Primary Examiner*—Hadi Shakeri
(74) *Attorney, Agent, or Firm*—Banner & Witcoff, Ltd

(57) ABSTRACT

A wrench set includes a drive handle with an impact end and a drive end. The drive end engages a drive wrench having a slot which receives the drive end of the drive handle. The opposite end of the drive wrench includes a laterally projecting or transversely projecting drive socket connection for attachment of any one of a set of sockets.

5 Claims, 2 Drawing Sheets

DRIVING WRENCH

BACKGROUND OF THE INVENTION

In a principal aspect, the present invention relates to a wrench comprised of a drive handle, a flat plate driving wrench and a set of sockets useful for turning headed bolts and other socket engaging fasteners positioned in limited access areas. Applicant's assignee, in U.S. Pat. No. 6,354,178 entitled "Impact Fan Clutch Wrench" issued Mar. 12, 2002 discloses a wrench set comprised of a driving handle and a flat plate wrench used for removing bolts in restricted locations. The identified patent is incorporated herewith by reference.

The wrench set disclosed in U.S. Pat. No. 6,354,178 is very useful for the purpose described in that patent; namely, removal of vehicle clutch assemblies. In order to be useful, the drive plate wrench, which is utilized to engage a nut associated with a fan clutch assembly, must be uniquely sized to cooperate with a uniquely sized nut associated with the fan clutch assembly. Thus, a series of drive plate wrenches are required in order to effect removal or tightening of the retention nuts for a fan clutch assembly. There has remained, however, the need to have a wrench tool which may be used to tighten or remove various sizes of fasteners or nuts and which may be easily adjusted to engage such fasteners or nuts including nuts positioned in limited access conditions.

SUMMARY OF THE INVENTION

Briefly, the present invention comprises a wrench set which includes a drive wrench and drive handle having an impact clement at one end and a driver for engaging the drive wrench at the opposite end. The drive handle is an elongate member and is generally of limited thickness so that it will fit into a restricted or narrow space.

A single drive wrench is used in combination with the drive handle. The single drive wrench is relatively short compared to the drive handle and is typically formed from a flat metal plate. A drive socket connection is provided at one end of the plate. This drive socket connection comprises a drive member for a socket. The drive member projects in a perpendicular direction from the flat plate. A slot is formed in the flat plate at the opposite end of the drive wrench having a configuration that enables driving of the drive wrench by the drive handle. The slot thus opens outwardly from the end of the drive end of the drive wrench and is shaped to include portions extending transversely to the open end slot to thereby define arcuate drive surfaces. As a result, the drive wrench may be positioned in a manner which will enable a socket attached to the one end of the drive wrench to extend outwardly from the flat plate in a perpendicular direction in either of two orientations of the drive wrench plate and be driven about the turning axis of the socket by the drive handle. Any one of a set of sockets may be used in combination with the drive wrench socket drive member, and the drive wrench may be positioned in relation to the drive handle in various orientations; that is, the drive wrench plate may be positioned to orient the socket to extend outwardly from the flat drive wrench plate in either of two directions and thus may be driven about the drive axis of the socket by means of the drive handle.

Thus, it is an object of the invention to provide an improved, multi-part drive wrench construction wherein the construction includes a drive wrench comprised of a flat plate capable of being combined with any one of a number of sockets attached to the end of the plate to drive a nut or other fastener.

It is a further object of the invention to provide a reasonably priced drive wrench set which is rugged, economical, easy to manipulate in restricted as well as unrestricted spaces and which is reversible.

Further, it is an object of the invention to provide a drive wrench set which may be used in combination with a pneumatic driver, or other types of driving devices, to detach or unscrew a bolt or fastener or to attach a bolt or fastener quickly and easily regardless of the orientation of the bolt or fastener.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Referring to the figures, the wrench set of the invention includes a nut driving or loosening wrench plate, drive wrench component or element 10 and a separate drive handle element or component 12. The drive wrench component or element 10 and drive handle 12 are used in combination to remove various nuts and fasteners located in the restricted access locations by means of a socket sized to engage the nut or fastener in that restricted access location.

Figure 2:
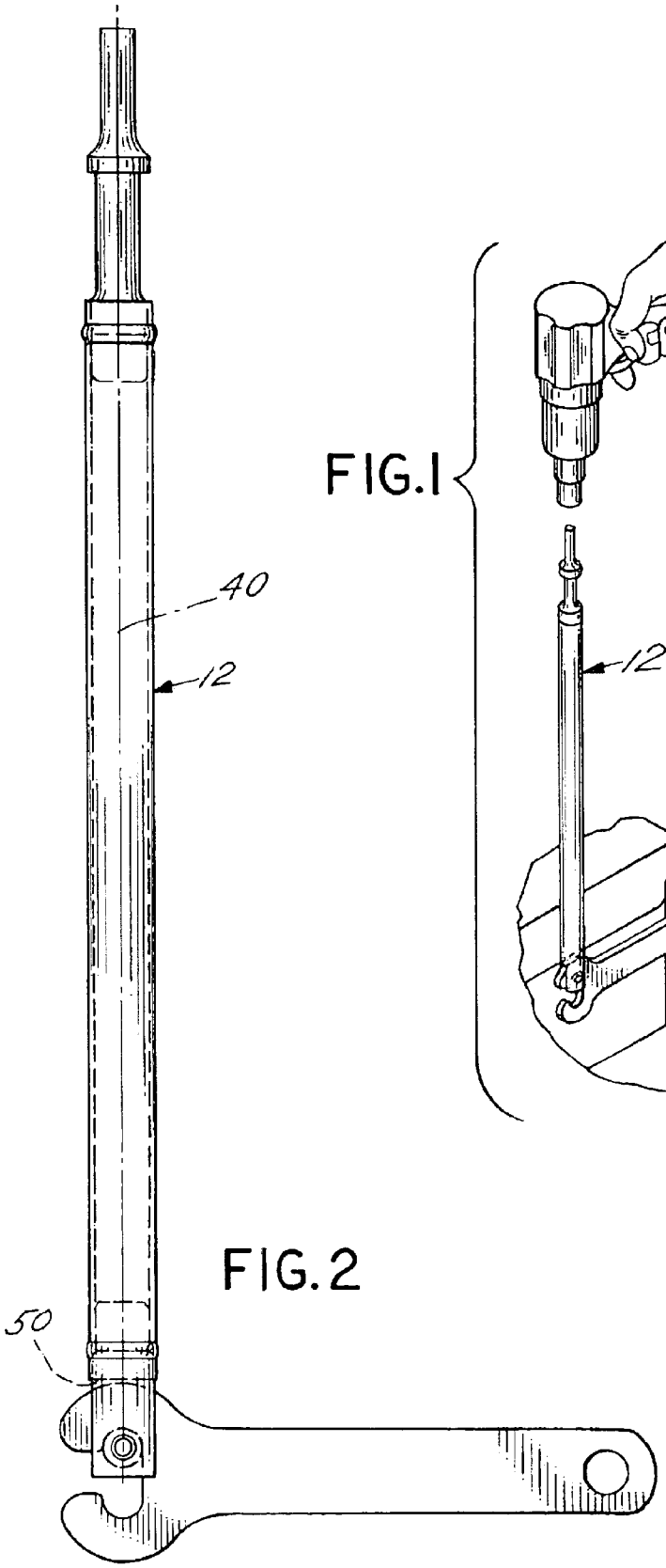
FIG. 2 is a plan view of the drive wrench of FIG. 1 wherein a socket may be attached to the drive wrench and oriented as depicted in FIG. 1.
Figure 1:
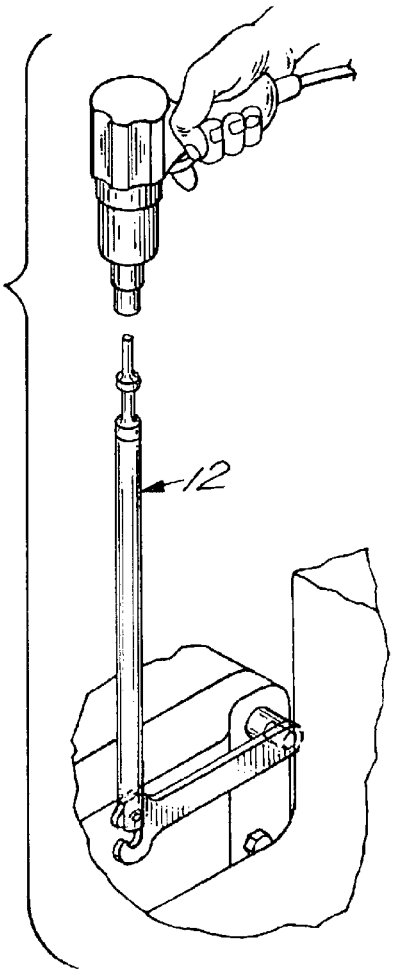
FIG. 1 is an exploded isometric view of the wrench set of the invention as utilized for loosening, detaching or attaching a fastener wherein a socket attached to the drive wrench is oriented in a first direction transverse or perpendicular to the plate of the drive wrench.
Figure 3:
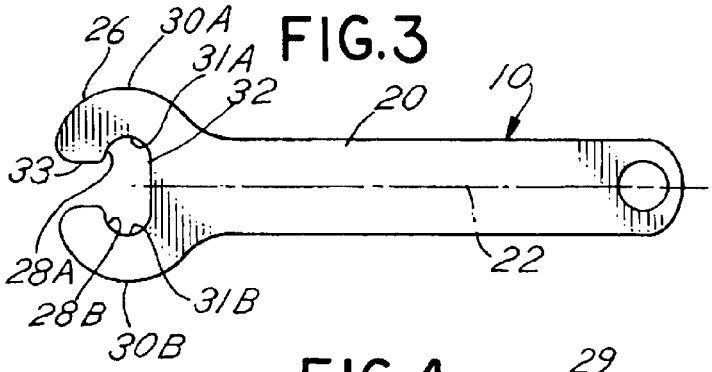
FIG. 3 is a plan view of the drive wrench of the invention.
Figure 4:
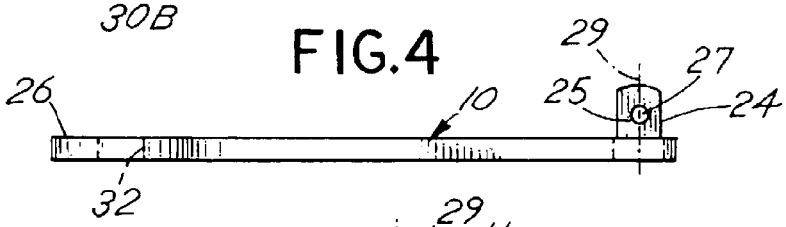
FIG. 4 is a side view of the drive wrench of FIG. 3 depicting the socket drive member.
Figure 5:
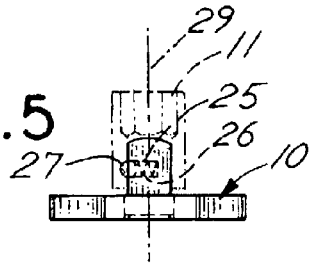
FIG. 5 is an end view of the drive wrench of FIG. 4 depicting the socket drive member for engaging a socket with the socket attached.
Figure 6:
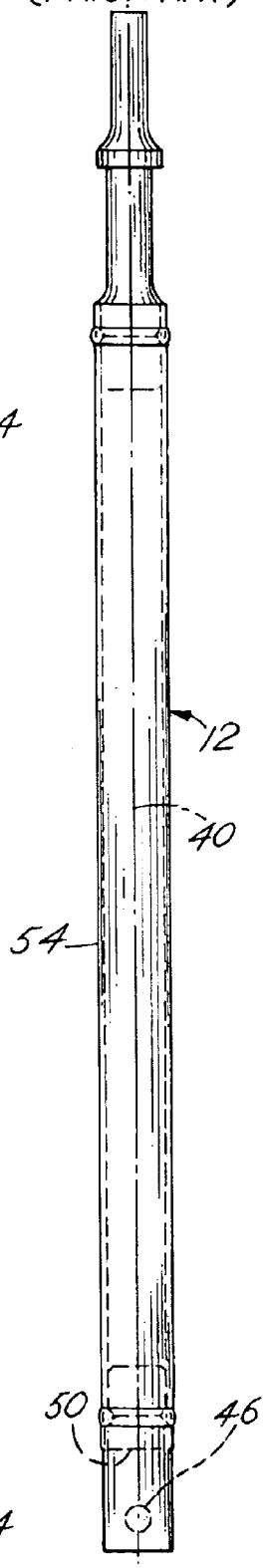
FIG.6 (PRIOR ART)
FIG. 6 is a plan view of the drive handle of the wrench set.

The functionality and methodology of use is depicted in FIG. 1. There a socket 11 is attached to the drive wrench component or element 10 and, more particularly, is attached to a socket driver 24 extending in a perpendicular or transverse direction from the flat plate comprising the drive wrench element 10. The socket 11 thus is attached to the drive wrench element 10. The drive wrench element 10 is then oriented properly so as to engage a compatible nut or fastener. The drive handle element 12 then is engaged with the drive wrench element 10 to transmit a turning force to the socket 11. The force is provided, for example, by a pneumatic impact hammer which engages against one end of the drive handle 12.

Any one of a number of sockets 11 from a socket set may thus be used in combination with the drive wrench 10. As a result, a plurality of separate drive wrenches 10 is not required. Rather, sockets 11 are utilized in combination with a single drive wrench 10 and a single drive handle 12. The particular configuration, size and length of a socket 11 may thus be chosen to accommodate the needs of the mechanic or other person utilizing the tool. The sockets 11 may also be easily changed to accommodate various sizes of nuts or fasteners. The drive element 10 may be reversed relative to the drive handle 12 to accommodate fastener orientations. The ability to reverse the relationship of the handle 12 and drive wrench 10 is associated with the structure of the driving slot or opening in the drive wrench as discussed hereinafter. It is further to be noted that the length of the drive wrench 10 and drive handle 12 may be adjusted to accommodate various needs and provide a desired mechanical advantage.

Figure 7:
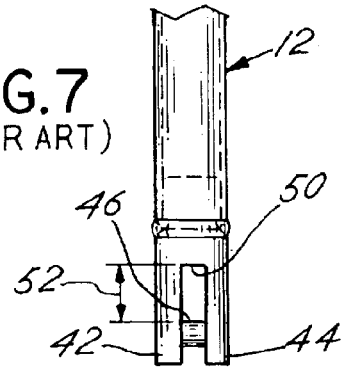
FIG.7 ( PRIOR ART)
FIG. 7 is a partial plan view of the handle of FIG. 6 rotated by 90° relative to FIG. 6.

The drive handle 12 comprises a rod or tube 54 with a longitudinal axis 40. Parallel, spaced arms 42 and 44 defining a yoke are positioned at one end of the drive handle 12. The arms 42, 44 are connected by an integral cylindrical member or pin 46. Member 46 is transverse to the longitudinal axis 40. Arms 42 and 44 are spaced from one another slightly greater than the width of the driving wrench plate 10 so that the arms 42, 44 can easily fit over the sides of the plate 10 and so that the member 46 can slide into a slot 32 in the end of plate 10 opposite the socket drive member 24. The member 46 is spaced from an upper impact surface 50 defined between the arms 42 and 44 at the top end of the slot between the arms 42 and 44 at a distance slightly greater than the maximum dimension of the width or distance between the top 31 of the slot 32 and the arcuate surface 30; namely, the dimension exemplified by the distance 52 in FIG. 7. Thus, the member 46 may easily slide into slot 32 with some space or play available between the surface 50 and the surface 30. The drive handle 12 is typically formed from a steel tube 54. The arms 42 and 44 are part of an investment casting that is laser welded into the tube 54.

The drive wrench 10 includes a lever arm 20 with a longitudinal lever arm axis 22 extending along the length of the lever arm 20. The lever arm 20 is typically 4 to 10 inches in length. The drive wrench or plate 10 is made from flat planar steel plate material. The drive wrench 10 includes the socket drive member 24 at one end and the slot 32 at the opposite end 26. The drive member 24 includes a counterbore 25 with a spring 26 biasing a ball bearing 27 to act as a means for retention of a socket 11 on the drive member or drive 24. Thus, a socket 11 of a desired size may be affixed to the plate 10 with the axis 29 of the socket 11 extending in a perpendicular direction from the flat plate 10 and congruent with the axis of drive member 24.

The opposite end 26 of the drive wrench 10 includes slot 32 having an opening 33 generally aligned with and symmetrical with the axis 22. The opening 33 is sized to receive the member 46 of the drive handle 12. Thus, the member 46 fits through the opening 33. The opening 33 of slot 32 further connects to opposed slot sections 28A and 28B generally transverse to the axis 22 and which each include arcuate ends 31A and 31B respectively. The ends 31A and 31B have an arcuate configuration which is sized and designed to be compatible with the configuration, shape and arcuate configuration of the member 46. Thus, the arcuate surfaces 31A, 31B are preferably a circular arcuate configuration in opposed relation to the axis 22 and the arcuate surfaces 31A, 31B are each spaced from the axis 22 by an equal distance. The transverse slot sections 28A, 28B are thus symmetrical about the axis 22. As a result, the drive wrench 10 may be reversed in orientation relative to the drive handle 12 so that a socket 11 attached to the socket drive 24 may be positioned to extend in either perpendicular direction from the drive wrench 10. In other words, the drive wrench 10 is reversible with respect to the drive handle 12.

The drive handle 12 may be positioned with an arcuate driving surface 50 generally having a curvature for engaging either driven surface 30A or 30B of wrench 10 to thereby drive a socket 11. The wrench 10 is thus totally reversible. Also, the handle 12 may be pulled to cause member 46 to engage a surface 31A or 31B to tighten or loosen a fastener.

Further, the drive wrench 10 is designed to accommodate sockets having various sizes. Thus, the complete tool described will include the drive handle 12, the drive wrench 10 and a set of sockets 11. With the subject matter of the invention, therefore, the utilization of the device in restricted locations is enhanced. An improved mechanical advantage is provided and the ability to accommodate nuts and fasteners of multiple sizes is enabled.

It is to be noted that variations of the described construction are possible. The orientation of the drive for the sockets may be adjusted from a perpendicular direction by a limited amount. The configuration of the arcuate slot 32 and opening 33 may be adjusted for cooperation with a member 46 having various configurations. Thus, the invention is to be limited only by the following claims and equivalents.

What is claimed is:

1. A driving wrench set comprising, in combination:

a driving wrench including a flat plate lever arm having a longitudinal axis with a socket connection first end and a drive slot at an opposite, second end, said socket connection comprising a drive for sockets mounted on and projecting along a socket drive axis generally intersecting the longitudinal axis and extending in a perpendicular direction from the flat plate, said drive slot at said second end being transverse to the longitudinal axis and symmetrical about the longitudinal axis, an opening extending along the longitudinal axis to the drive slot, said second end of said driving wrench further including first and second opposed, spaced drive handle engaging surfaces; and a drive handle having a longitudinal axis, a first end for receiving a ram force and a second end including first and second, spaced, parallel arms for fitting over the flat plate between said arms and a drive surface between said arms for engaging one of said driving wrench drive handle engaging surfaces, said drive handle further including a connecting pin between the arms for fitting through the opening into the drive slot, said drive handle drive surface comprising means for engagement thereof with either of said drive handle engaging surfaces of said driving wrench for driving of the flat plate in either rotational direction about the socket drive axis.

2. The tool set of claim 1 including a socket affixed to the drive for sockets.

3. The tool set of claim 1 including a plurality of distinctly sized sockets, each of said sockets capable of engagement with the drive for sockets.

4. The tool of claim 1 wherein the tool handle drive surface and the flat plate handle engaging surfaces are arcuate and compatible.

5. The tool of claim 1 wherein the flat plate handle engaging surfaces are equally spaced from the longitudinal axis.

* * * * *